US007600421B1

(12) United States Patent
Hollis et al.

(10) Patent No.: US 7,600,421 B1
(45) Date of Patent: Oct. 13, 2009

(54) INSTRUMENTED BALLISTIC TEST PROJECTILE

(75) Inventors: Michael Hollis, Flanders, NJ (US); Matthew Hawkswell, Blairstown, NJ (US); Roger St Ours, Hopatcong, NJ (US); Donald Carlucci, Sparta, NJ (US); Boris Flyash, Wayne, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 164 days.

(21) Appl. No.: 11/567,938

(22) Filed: Dec. 7, 2006

(51) Int. Cl.
*G01L 5/14* (2006.01)

(52) U.S. Cl. ..... 73/167; 73/89; 102/510; 42/1.01; 42/1.06

(58) Field of Classification Search ..... 73/167, 73/89; 102/510; 42/1.01, 1.06
See application file for complete search history.

(56) References Cited

U.S. PATENT DOCUMENTS 3,838,645 A * 10/1974 Finger et al. ..... 102/211
4,640,195 A * 2/1987 Campoli ..... 102/430
4,802,415 A * 2/1989 Clarke et al. ..... 102/434
4,877,201 A * 10/1989 Trayner ..... 244/3.21
5,164,540 A * 11/1992 Chiarelli et al. ..... 102/526
5,414,347 A * 5/1995 Monk et al. ..... 324/73.1
H1534 H * 6/1996 Fritch ..... 102/473
5,788,178 A * 8/1998 Barrett, Jr. ..... 244/3.11
6,090,178 A * 7/2000 Benini ..... 75/245
6,378,437 B1 * 4/2002 Burke et al. ..... 102/293

* cited by examiner

*Primary Examiner*—Hezron Williams
*Assistant Examiner*—Rachel Black
(74) *Attorney, Agent, or Firm*—John F. Moran

(57) ABSTRACT

A ballistic test projectile includes a nose section comprising a windshield and aft of the windshield, an ogive; a body section aft of the nose section, the body section comprising a generally cylindrical body connected to the ogive; a base section aft of the body section, the base section comprising a base adapter connected to the body and a base bottom connected to the base adapter; a base pressure gage disposed in the base bottom; at least one side pressure gage disposed in the body; and an electronics cup disposed in the body, the electronics cup comprising a battery cup, a signal conditioning cup, a multiplexer cup, an accelerometer cup and a transmitter cup.

14 Claims, 5 Drawing Sheets

INSTRUMENTED BALLISTIC TEST PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to ballistic munitions and in particular to ballistic projectiles that measure conditions in the launching tube.

Military organizations have always needed a device to obtain information about the interior ballistic environment of cannon launching projectiles. Knowledge of launching conditions is used to design cannons and munitions to achieve optimum launching and accuracy. Only within the past 50 years have scientists started placing sensors into projectiles to record the interior ballistic event. Early electronic devices were pressure sensors that were hard-wired to a data acquisition system located near the cannon. When the projectile was launched, the data acquisition system would record several milliseconds of data before the wire was broken.

More recently, commercially available electronics have allowed the instrumentation of projectiles with small accelerometer sensors and pressure gages. These devices either recorded or telemetered data at a relatively low frequency rate, thus missing phenomena or smoothing out the data. Additionally, these older devices were one-time shot devices that were destroyed during the test.

SUMMARY OF THE INVENTION

It is an object of the invention to provide an instrumented ballistic test projectile that senses and transmits interior (inside of gun tube) ballistic information in realtime.

It is another object of the invention to provide an instrumented ballistic test projectile that is reusable, with little or no refurbishment.

It is a further object of the invention to provide an instrumented ballistic test projectile that measures base pressure and side wall pressure.

One aspect of the invention is a ballistic test projectile comprising a nose section including a windshield and aft of the windshield, an ogive; a body section aft of the nose section, the body section comprising a generally cylindrical body connected to the ogive; a base section aft of the body section, the base section comprising a base adapter connected to the body and a base bottom connected to the base adapter; a base pressure gage disposed in the base bottom; at least one side pressure gage disposed in the body; and an electronics cup disposed in the body, the electronics cup comprising a battery cup, a signal conditioning cup, a multiplexer cup, an accelerometer cup and a transmitter cup.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The invention comprises a projectile that senses and transmits the interior ballistic event in realtime. The primary interest is in conditions inside the launch tube, however, the projectile may also be used to measure and transmit data once the projectile has exited the launch tube. The projectile may be launched from a cannon tube or mortar tube, for example. The instrumented ballistic test projectile is rugged enough so that most of its components are reusable, with limited refurbishment. The present invention withstands the high acceleration and spin rate of the cannon launching environment.

A combined telemetry and sensor system and hardened projectile body allow the capture of the pressurized environment on the base and side of the projectile as it is being launched. A tri-axial accelerometer module senses the acceleration forces in all three linear directions. The signals from the sensors are combined and transmitted at an extremely high rate so as not to degrade the signals. Receiving antennae located near the muzzle exit of the cannon receive the signals from the on-board transmitter. A ground station receives and records the data. The projectile can be recovered and, with minor refurbishment, reused. Reusing the projectile saves money.

The invention incorporates a modularized power supply, accelerometer module and signal conditioning and telemetry system with an integrated antenna. In one embodiment, the telemetry system is an analog system which multiplexes signals and then transmits them. In another embodiment, the telemetry system is a digital system. The modularized system easily plugs into the projectile body, which has integral pressure gages in the side wall and in the base. Several gages are located in the wall and generally one gage is located in the base. An ogive and windshield make up the forward section of the projectile, protecting the electronics from gun launch and ground impact. In the event that the ground impact damages the windshield or ogive, these parts are easily replaceable.

During launch, the slip band obturator is destroyed. The slip band obtrurator is a band on the base of the projectile that seals the expanding cannon gases from leaking past the projectile. The base easily comes off and can be replaced if damaged. When the base is removed, the obturator band is then replaced.

Figure 1:
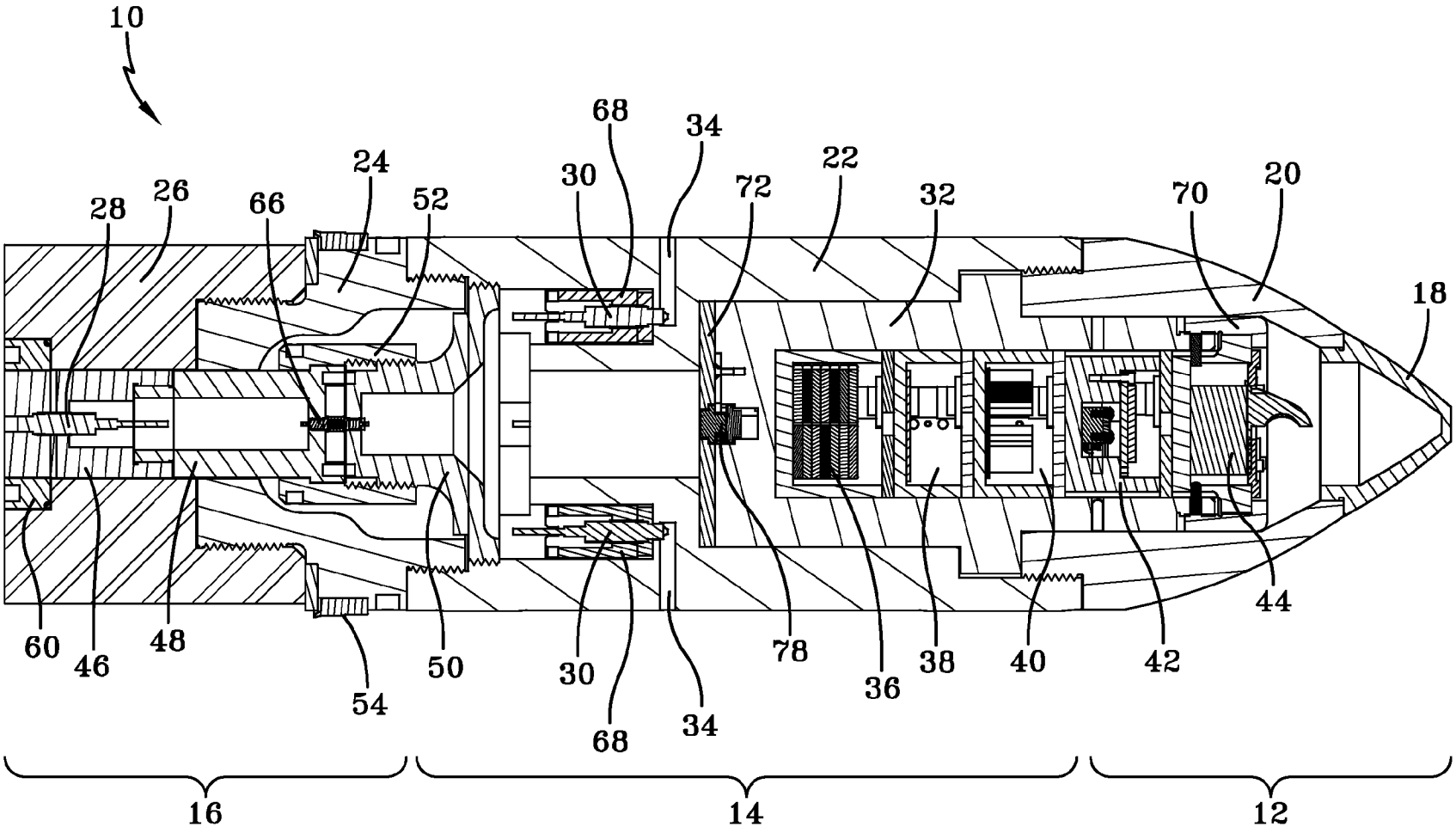
FIG. 1 is a sectional view of one embodiment of an instrumented ballistic test projectile in accordance with the invention.
Figure 2:
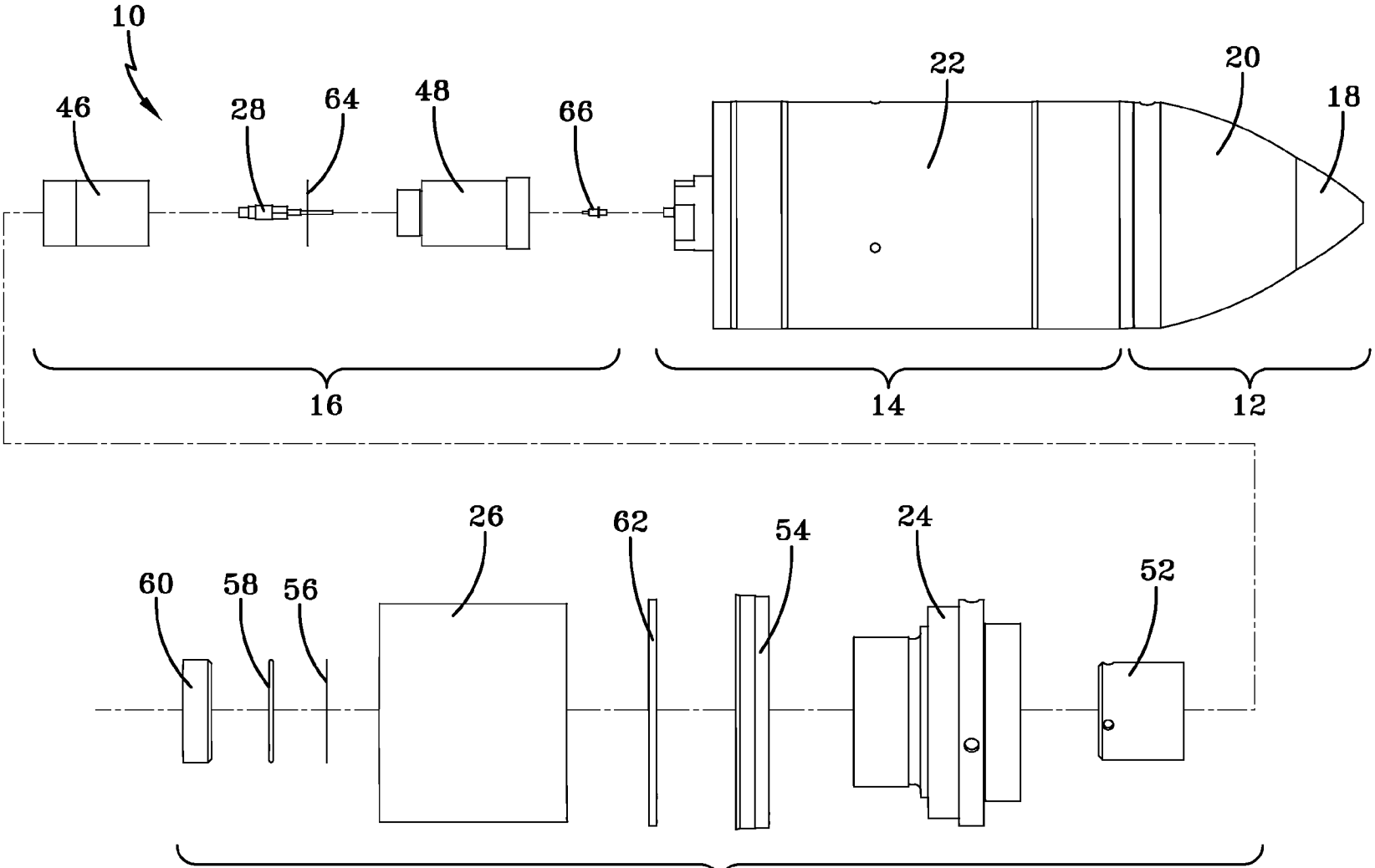
FIG. 2 is an exploded view of FIG. 1.

FIG. 1 is a sectional view of one embodiment of an instrumented ballistic test projectile 10 in accordance with the invention. FIG. 2 is an exploded view of FIG. 1. Referring to FIGS. 1 and 2, projectile 10 includes a nose section 12, a body section 14 and a base section 16. Nose section 12 includes a windshield 18 and aft of the windshield 18, an ogive 20. Body section 14 is disposed aft of the nose section 12 and includes a generally cylindrical body 22 connected to the ogive 20 with, for example, threads. Base section 16 is disposed aft of the body section 14 and includes a base adapter 24 connected to the body 22 and a base bottom 26 connected to the base adapter 24. In the embodiment shown, the connections between the body 22, base adapter 24 and base bottom 26 are threads, although other types of connections may be used.

A base pressure gage 28 is disposed in the base bottom 26. The base pressure gage 28 measures pressure at the base of the projectile 10. At least one side pressure gage 30 is disposed in the body 22. Preferably, a plurality of side pressure gages 30 (for example, four) are disposed circumferentially around the body 22 equidistant from each other. Side pressure gages 30 measure pressure along the side wall of projectile 10. Passageways 34 in body 22 connect the side pressure gages 30 to the side wall pressure field. An electronics cup 32 is disposed in the body 22 and includes a battery cup 36, a signal conditioning cup 38, a multiplexer cup 40, an accelerometer cup 42 and a transmitter cup 44.

The base pressure gage 28 with shim 64 is disposed in a protective base gage holder 46. Shim 56, O-ring 58 and rear nut 60 fit on the aft end of the base gage holder 46. A base gage tube 48 threads into the forward end of the base gage holder 46. A base tube captive ring 52 attaches the base gage tube 48 to the rear nacelle 50. Coaxial plug 66 electrically connects the base pressure gage 28 to wiring (not shown) inside the rear nacelle 50.

An obturator 54 and obturator ring 62 (FIG. 2) are disposed on the base section 16. In one embodiment, the obturator 54 is a slip obturator such that substantially no spin is imparted to the projectile 10. A non-spinning projectile 10 is desirable to limit the range of the projectile. In most cases, the ballistic information that is desired relates to conditions inside the launch tube. Therefore, it is not necessary that the projectile 10 have any range beyond the muzzle of the tube. Spinning projectiles are much more stable than non-spinning projectiles and, therefore, have longer ranges. A non-spinning projectile is unstable and will, for example, turn sideways or turn completely around after exiting the tube. This behavior creates a lot of drag, which lessens the range of the projectile 10.

Figure 3:
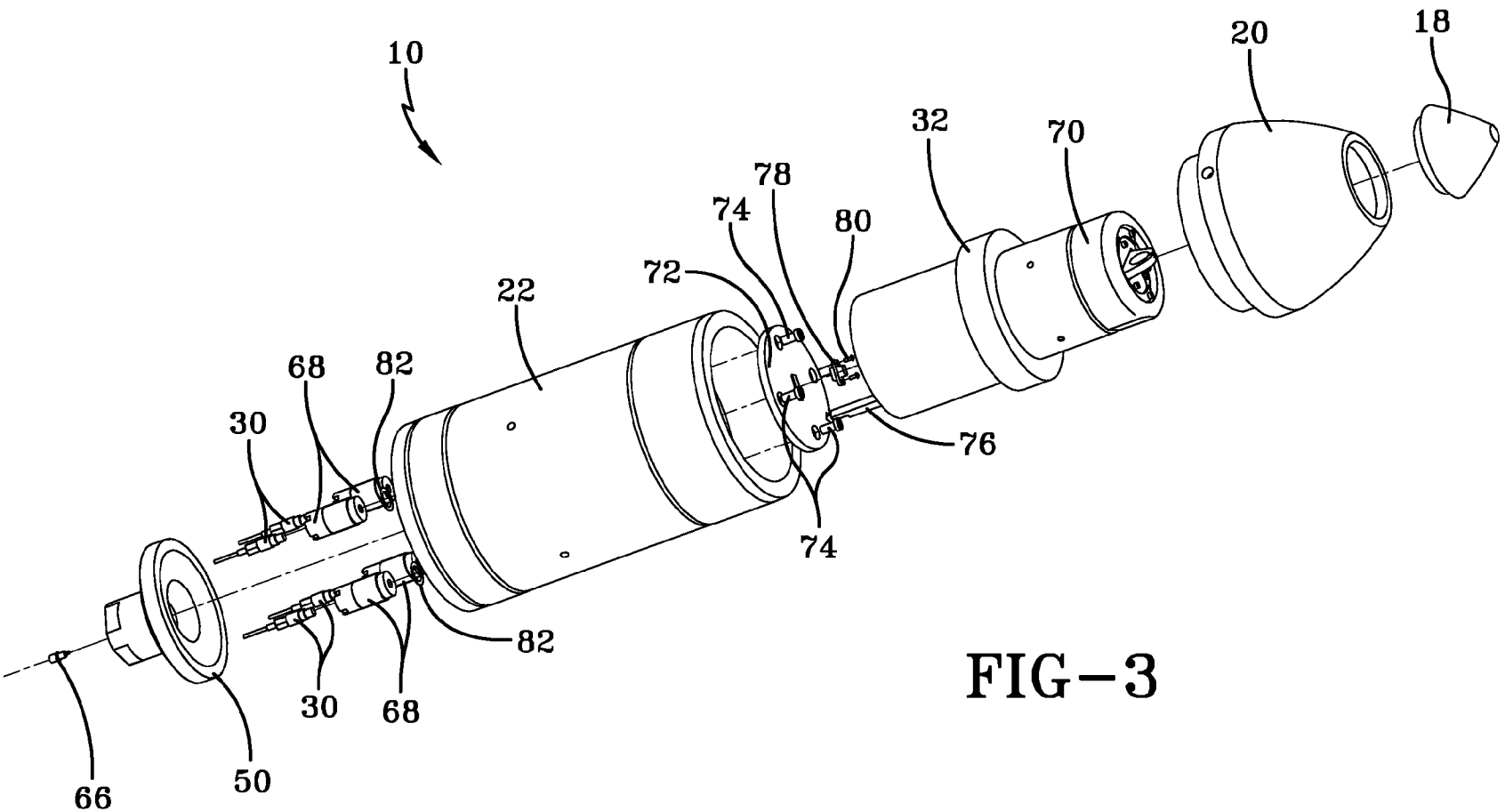
FIG. 3 is an exploded view of the nose and body sections of the projectile of FIG. 1.

FIG. 3 is an exploded view of the nose and body sections 12,14 of the projectile 10. As seen in FIGS. 1 and 3, the electronics cup 32 is protected by the ogive 20 and body 22. This protection helps ensure that the electronic components survive the landing of the projectile 10. Should the nose section 12 of the projectile 10 become damaged, the windshield 18 and/or ogive 20 are easily replaceable. The windshield 18 comprises a material that is substantially transparent to radio frequency transmissions so that the information gathered by the projectile 10 may be transmitted. A receiving antenna (not shown) is located just past the muzzle of the launch tube. The receiving antenna is connected to a radio receiver and the electronic systems that analyze the data transmitted by the projectile 10.

FIG. 3 shows windshield 18; ogive 20; body 22; rear nacelle 50; four side pressure gages 30 with adapters 68 and shims 82; electronics cup 32 with retainer ring 70; electronics cup key 76 for assuring proper orientation of electronics cup 32; plate 72 that is attached to body 22 with screws 74; and an electrical connector 78 that is attached to plate 72 with screws 80. Electrical connector 78 (see also FIG. 4) connects the outputs of the base and side pressure gages 28, 30 to the electronics cup 32.

Figure 4:
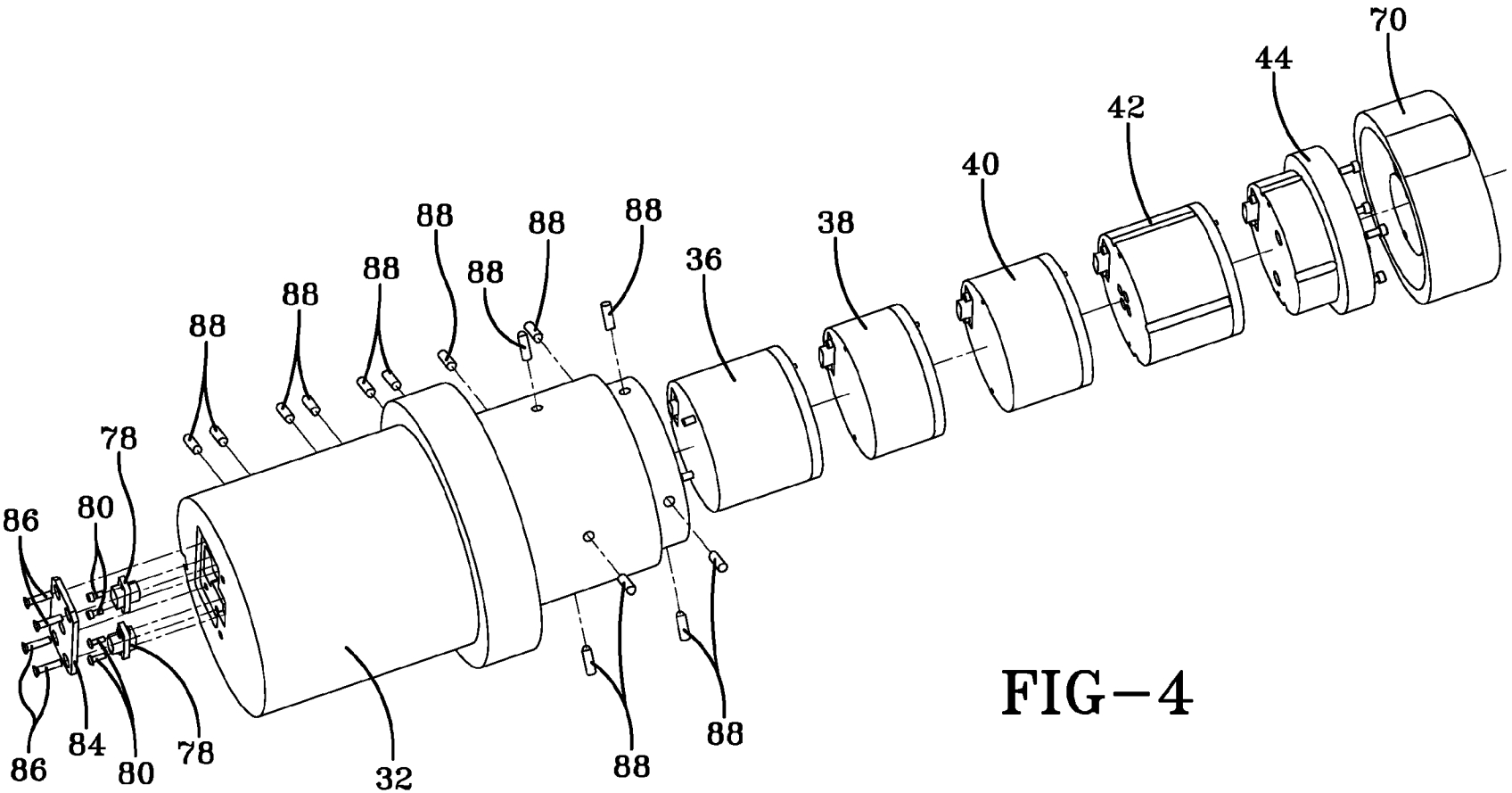
FIG. 4 is an exploded view of an electronics cup.
Figure 5:
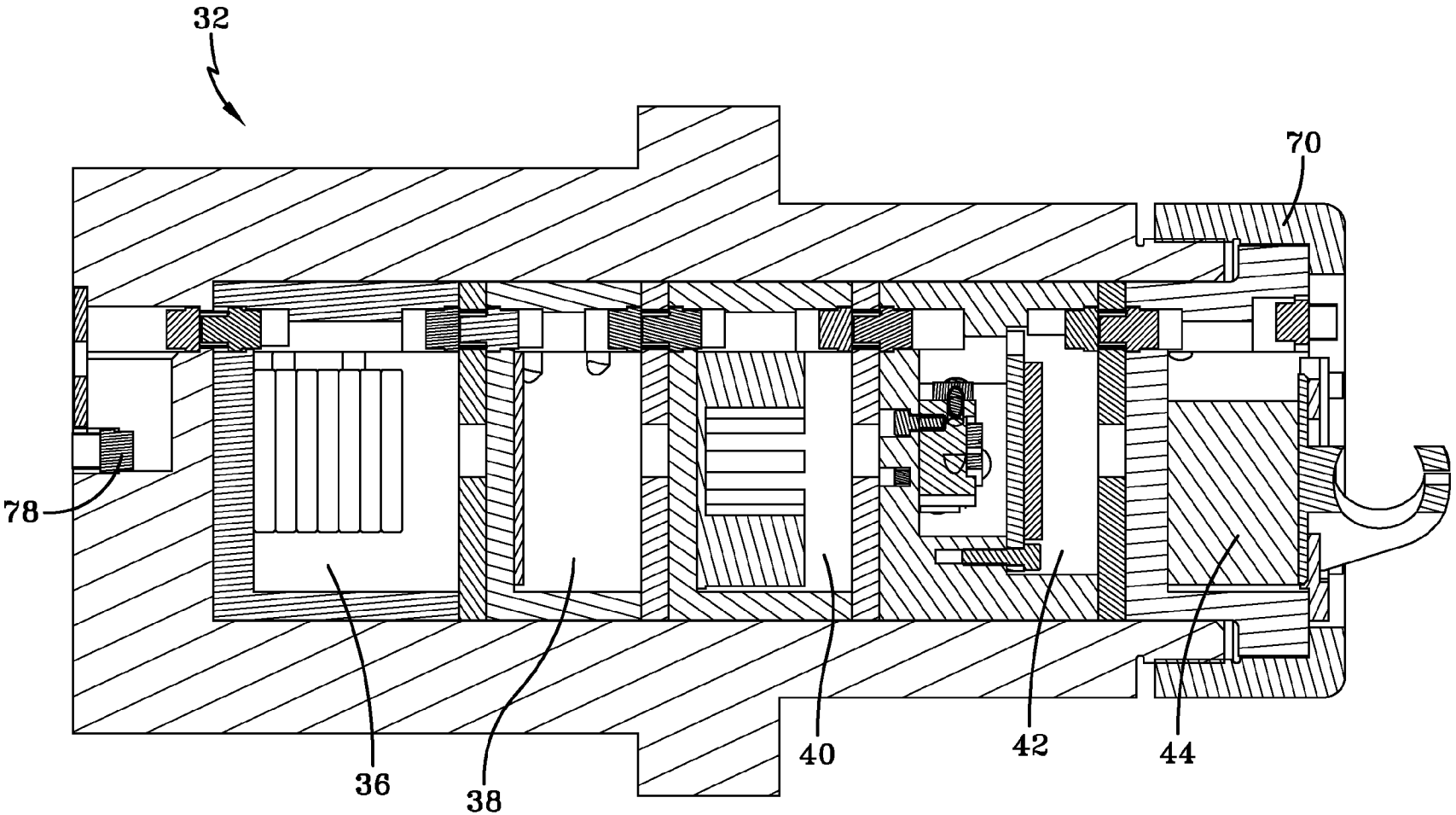
FIG. 5 is a sectional view of FIG. 4.

FIG. 4 is an exploded view of the electronics cup 32. FIG. 5 is a sectional view of FIG. 4. Referring to FIGS. 4 and 5, electronics cup 32 provides a protective enclosure for the electronic components of the projectile 10. Electronics cup 32 may be made of, for example, aluminum. Disposed in the electronics cup 32 are the battery cup 36, signal conditioning cup 38, multiplexer cup 40, accelerometer cup 42 and transmitter cup 44. Each "cup" is so named because of its shape. Each cup is a circuit board having a function related to its name. The battery cup 36 contains the power supply batteries. The signal conditioning cup 38 is a signal conditioning circuit. The multiplexer cup 40 is a multiplexer circuit. The accelerometer cup 42 comprises an accelerometer. In a preferred embodiment, the accelerometer is a tri-axial accelerometer. The tri-axial accelerometer measures acceleration in three orthogonal directions. Transmitter cup 44 comprises a radio frequency transmitter. A retainer ring 70 secures the various components in the electronics cup 32. Potting lid 84 is secured with screws 86. A plurality of set screws 88 secure the cups 36, 38, 40, 42, 44 in place with respect to electronics cup 32.

The electronic "cups" plug into and are stacked on top of each other in the electronics cup 32. Because functionality is separated by "cup", the overall function of the electronics cup 32 may be varied by substituting other component cups (not shown). The plug-in modularity of the electronics cup 32 makes the projectile 10 easily reconfigurable. Also, in case the electronic components are damaged, the cups are easily replaceable, so that the projectile 10 has a short down time.

Experience has shown that the projectile 10 may land on its nose or its base. The ogive 20 preferably comprises aluminum. If the ogive 20 and windshield 18 (FIG. 1) are damaged, they are easily replaced because of their threaded connections. When the slip obturator (FIG. 1) is used, the projectile 10 has little or no spin and more often will land on its base. Thus, base bottom 26 (FIG. 1) preferably comprises aluminum. Base bottom 26 is threaded onto base adapter 24 for easy replacement, if necessary. The body 22, base adapter 24 and rear nacelle 50 preferably comprise steel. These components provide strength to the projectile 10 and protect the electrical components inside the projectile. In a typical landing, these components will not be damaged.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A ballistic test projectile, comprising:

a nose section comprising a windshield and aft of the windshield, an ogive;

a body section aft of the nose section, the body section comprising a generally cylindrical body connected to the ogive;

a base section aft of the body section, the base section comprising a base adapter connected to the body and a base bottom connected to the base adapter;

a base pressure gage disposed in the base bottom;

at least one side pressure gage disposed in the body;

an electronics cup disposed in the body, the electronics cup comprising a battery cup, a signal conditioning cup, a multiplexer cup, an accelerometer cup and a transmitter cup; and an obturator disposed on the base section, the obturator being a slip obturator such that substantially no spin is imparted to the projectile during its launch reducing its flight stability while increasing its drag and reducing its velocity and range so that the projectile is able to be recovered and reused with minor refurbishment.

2. The projectile of claim 1 wherein at least one side pressure gage comprises a plurality of side pressure gages and the body section comprising steel, the plurality of side pressure gages located in the body section for protection and the body section having passage ways connecting the side wall pressure gages to a region of the side wall to measure field pressure in the body section for protection while protected by the body section.

3. The projectile of claim 2 wherein the plurality of side pressure gages are circumferentially disposed around the body at substantially equidistant points.

4. The projectile of claim 1 wherein the windshield comprises a material that is substantially transparent to radio frequency transmissions.

5. The projectile of claim 1 wherein the ogive comprises aluminum.

6. The projectile of claim 1 wherein the accelerometer cup comprises a tri-axial accelerometer.

7. The projectile of claim 1 wherein the body and the base adapter comprise steel.

8. The projectile of claim 1 wherein the base bottom comprises aluminum.

9. The projectile of claim 1 further comprising a protective base gage holder wherein the base pressure gage is disposed in the protective base gage holder.

10. The projectile of claim 9 wherein the base gage holder comprises steel.

11. The projectile of claim 9 further comprising a base gage tube attached to a forward end of the base gage holder, and a rear nacelle attached to a forward end of the base gage tube and an aft, interior end of the body.

12. The projectile of claim 11 further comprising a base tube captive ring that attaches the base gage tube to the rear nacelle.

13. The projectile of claim 1 wherein the electronics cup is surrounded by the body and the ogive.

14. The projectile of claim 1 wherein the electronics cup, the battery cup, the signal conditioning cup, the multiplexer cup, the accelerometer cup and the transmitter cup comprise plug-in modules.

* * * * *